US005110004A

United States Patent [19]

Albanesi et al.

[11] Patent Number: 5,110,004

[45] Date of Patent: May 5, 1992

[54] LID ASSEMBLY

[75] Inventors: Mario Albanesi, Rome, Italy; Willy A. M. Hertogs, Sint Katelijne Waver, Belgium; Adil M. Khan; Lucio Pieroni, both of Rome, Italy

[73] Assignee: The Procter & Gamble Company, Cincinnati, Ohio

[21] Appl. No.: 497,476

[22] Filed: Mar. 22, 1990

[30] Foreign Application Priority Data

Mar. 23, 1989 [IT] Italy ..... 19878 A/89

[51] Int. Cl.[5] ..... B65D 43/06

[52] U.S. Cl. ..... 220/355; 220/307; 229/125.13

[58] Field of Search ..... 220/306, 339, 400, 404, 220/366, 259, 355, 356, 357, 307; 215/355, 343, 345, 354; 383/33, 36; 426/110, 398, 411, 413, 124, 131; 229/125.13, 125.08

[56] References Cited

U.S. PATENT DOCUMENTS

| | | | |
|---|---|---|---|
| 3,025,991 | 3/1962 | Gillon | 215/355 |
| 3,165,227 | 1/1965 | Crowell et al. | 220/355 |
| 4,098,422 | 7/1978 | Slomski | 215/355 |
| 4,170,315 | 10/1979 | Dubach et al. | 220/339 X |
| 4,373,636 | 2/1983 | Hoffman | 220/366 |
| 4,394,928 | 7/1983 | Philip | 220/366 |
| 4,454,958 | 6/1984 | Juillet et al. | 220/339 |
| 4,576,309 | 3/1986 | Tzifkansky et al. | 220/366 |
| 4,813,563 | 3/1989 | Ogden et al. | 215/355 |
| 4,892,247 | 1/1990 | Dirksing et al. | 229/125.26 |
| 4,917,263 | 4/1990 | Korb | 220/400 |

FOREIGN PATENT DOCUMENTS

| | | |
|---|---|---|
| 0252039 | 1/1988 | European Pat. Off. . |
| 2529865 | 1/1984 | France . |
| 511226 | 8/1939 | United Kingdom . |
| 1397242 | 6/1975 | United Kingdom . |

*Primary Examiner*—Stephen P. Garbe
*Assistant Examiner*—Paul A. Schwarz
*Attorney, Agent, or Firm*—E. Kelly Linman; Thomas H. O'Flaherty; Richard C. Witte

[57] ABSTRACT

In the closable lid assembly comprising two elements joined together by means of a hinge, provision is made for the first element or lid to have a channel-shaped peripheral cavity designed to receive the peripheral relief of the second element, in the form of a small frame, which has a flat flange designed to delimit the opening of the packaging onto which the assembly is applied. Either or both the flanks of the peripheral relief have corrugations which cooperate with the vertical walls of the channel provided in the movable lid element, such corrugations forming an airtight seal between the two elements of the assembly. In order to improve further the airtightness of the closure, a gasket is also provided on the bottom of the cavity and comes into abutment against the relief of the small frame.

4 Claims, 3 Drawing Sheets

LID ASSEMBLY

TECHNICAL FIELD

The present invention relates to a closable airtight lid assembly and, more particularly, to such an assembly for use with deformable containers.

BACKGROUND INFORMATION

Airtight lids for product packaging are known, but they are not suitable for being connected for example to a container which is easily deformable, nor with two different containers.

Lids of this type comprise a single element and form a seal with the opening of the container to which they are applied. Such a joining operation has the drawback that, when the container is deformed, the airtightness of the closure is not guaranteed. Moreover, if the wrapper containing the product is inserted inside an outer container, it is difficult to remove the product from the inner container. In both cases, however, it is necessary to separate the lid from the container in order to open the resultant packaging and this involves a certain inconvenience during use.

Other currently known lid assemblies which can be opened do not have, on the other hand, a good degree of airtightness on account of the imperfect adhesion between the respective walls of the movable part and of the fixed part joined together, which is sufficient to cause the aforementioned loss of airtightness.

DISCLOSURE OF INVENTION

The object of the invention is to provide a lid assembly which can be applied to containers having a certain rigidity but easily deformable, containing a product. It is designed to ensure perfect airtight closure of the product so that it retains its original properties and remains airtight even in situations where the container is deformed.

A further object of the invention is that it must also be possible for the lid assembly to be applied to packages consisting of a small inner bag or container (formed for example by a flexible sheet or film enclosing the product) within an outer containers having a certain rigidity but also easily deformable, the lid assembly being connected to both containers.

A further object of the invention is that it must be possible for the lid assembly to be applied to a package consisting of a simple bag of flexible material.

According to the invention, the closable airtight lid assembly is formed structurally by a movable lid, forming the actual closing part, having along its entire periphery a channel-shaped cavity designed to receive a peripheral relief provided in a second element or small frame. The lid and frame are integrally hinged to one another along a weakened section. The frame has a flange directed towards the inside, designed to delimit the opening of the packaging onto which the assembly is applied. Either or both of the flanks of the peripheral relief have flexible corrugations which cooperate with one or both the vertical walls of the channel-shaped cavity of the lid. When the lid and frame assembly are brought into pressure-contact with each other, the corrugations press against the internal vertical walls of the channel-shaped cavity formed in the lid, providing an airtight seal therebetween.

In order to improve further the airtightness of the closure, a gasket can be provided on the bottom of the channel-shaped cavity of the lid. This would then come into operation when the lid is closed, positioning itself above the small frame, with the gasket pressing against the peripheral relief.

In order to avoid accidental opening of the lid, provision is made for the snap-engagement of two bosses located on the contact walls of the lid and the small frame respectively, positioned opposite the hinge.

The front part of the movable lid, opposite the hinge, can be slightly curved so that, when this movable element is closed onto the small frame, the two lateral front edges come into contact first with the corresponding front edges of the small frame, thus ensuring preliminary engagement of these edges, followed by proper marrying of the entire contour of the front part of the movable lid onto the small frame. This makes it easy to close the lid by exerting pressure on the middle point of the front part. This arrangement is particularly suitable when the lid has a rectangular shape.

The small frame of the lid assembly according to the invention may be coupled either to a container possessing a certain rigidity, but easily deformable, fixing the outer edge thereof, for example by means of adhesive, inside an external peripheral groove in the small frame. Alternatively, it could be attached to a wrapper of the flexible type, with one of the faces of the wrapper fixed, for example by means of adhesive, to the underlying part of the peripheral flange on the small frame. Further, the frame could be joined simultaneously to an outer container and an inner container consisting of a flexible wrapper.

BRIEF DESCRIPTION OF THE DRAWINGS

The invention will now be described with reference to the accompanying drawings which show a non-limiting example of embodiment of the said invention.

In the drawings.

DESCRIPTION OF THE PREFERRED EMBODIMENT

Figure 1:
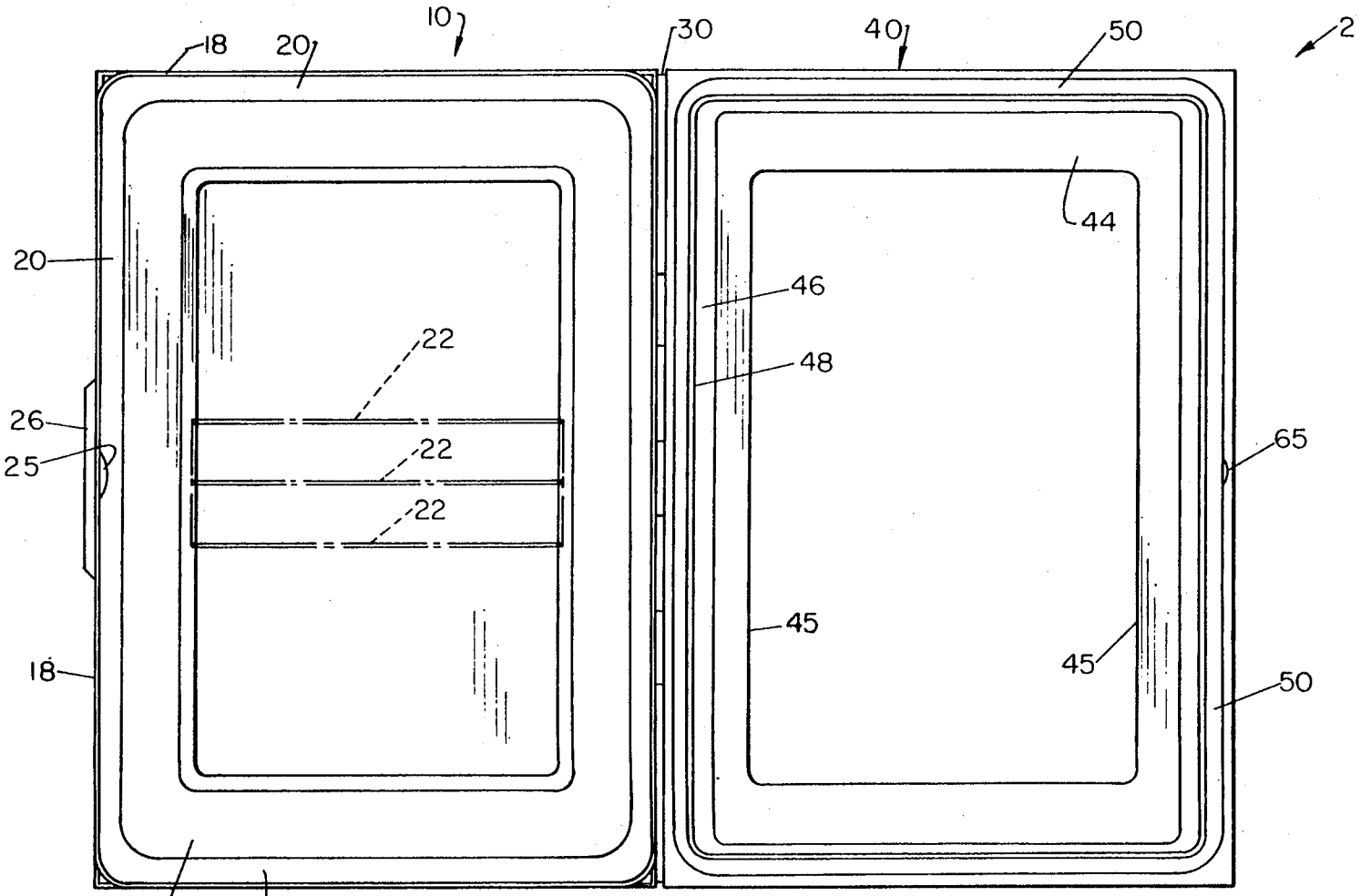
FIG. 1 shows a plan view of the closable lid assembly according to the invention, in the open position.

In FIG. 1, the lid assembly, indicated overall by 2, comprises a first element 10, constituting the lid proper, joined by means of a hinge 30 to a second element 40 constituting the small frame to which the package for the product is fixed. The hinge 30 is formed, integrally with the lid 10 and the small frame 40, from the same material itself, for example mouldable plastic of suitable flexibility.

Figure 2:
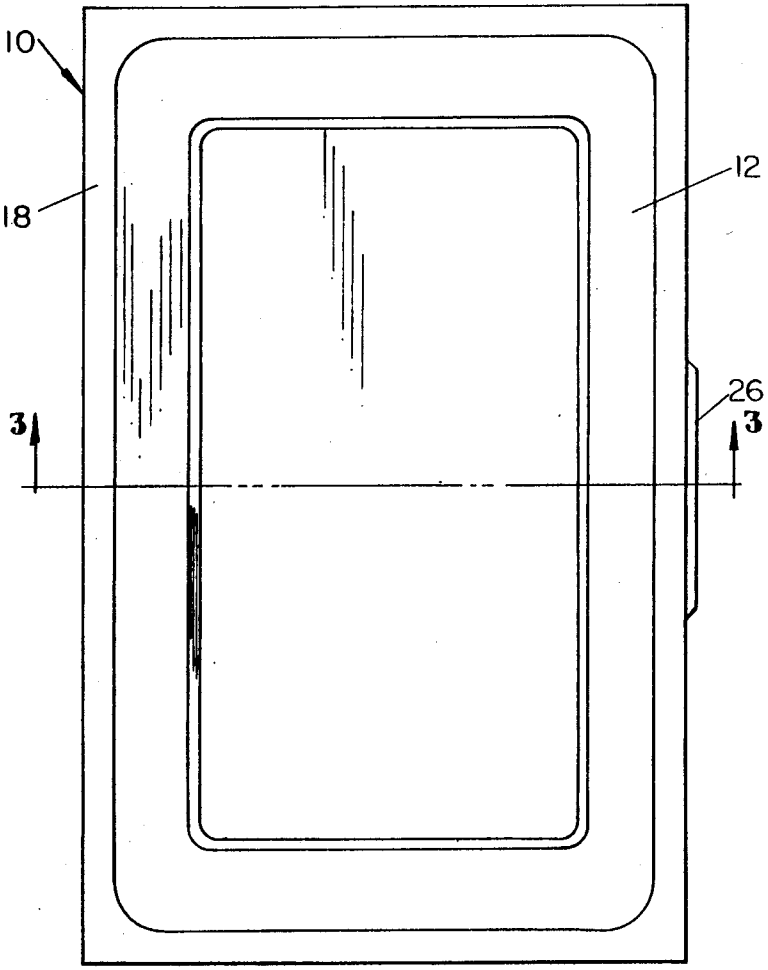
FIG. 2 shows a plan view of the closed lid assembly.
Figure 3:
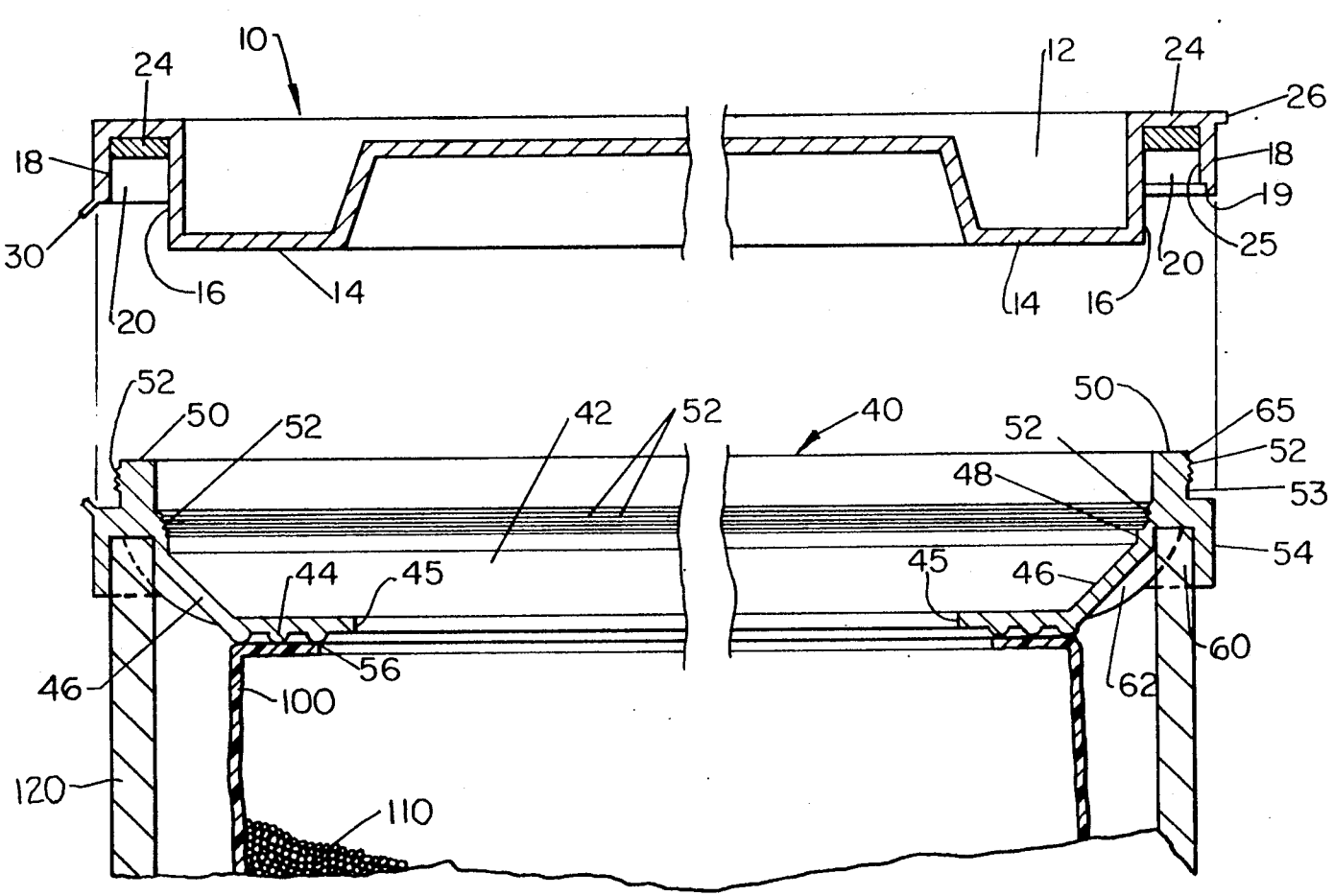
FIG. 3 shows, on a larger scale, along the cross-section 3—3 of FIG. 2, the elements of the lid assembly being disconnected from each other and located one above the other in an exploded position.

The first element 10 of the assembly (see FIGS. 2 and 3) comprises an upper funnel 12 which forms, in the bottom part, a closed ring-shaped rim 14, the peripheral wall 16 of which delimits, together with the wall 18 of the lid, a channel-shaped cavity 20, the vertices of which are suitable rounded.

The small frame 40, having externally the same dimensions as the lid 10, forms an inner cavity 42 having at the bottom a flat inwardly extending flange 44 possessing an opening 45 for access to the package, the walls of said cavity 42 rising symmetrically along the entire periphery, with a first lower section 46 which is steeply inclined followed by a section 48 which is slightly inclined relative to the vertical, so as to form a relief 50 which is positioned, when the lid is closed, inside the channel 20 of the lid.

The inclination of the connecting surface between the flange and the relief is particularly suitable for the application of the lid onto containers which contain granular products, so as to enable the latter to flow out more easily.

On the section 48 of the wall on the inside of the cavity 42 there is arranged a series of corrugations 52 which possess a certain flexibility and cooperate with the internal vertical wall 16 of the channel-shaped cavity 20 creating an airtight seal between the two elements of the lid assembly.

These corrugations 52 may also be present on the external peripheral wall 53 of the relief 50.

In order to improve further the airtightness of the closure, a gasket 24 is provided on the bottom of the channel 20 surrounding the rim 14 of the lid 10 so as to form a further seal in abutment with the peripheral relief 50 of the small frame 40.

Below the flat flange 44 there are provided ribs 56 which promote leakproof fixing with the wall of the container 100, for example a bag with a product 110, such as coffee, inside a flexible packaging, obtained for example by means of gluing with suitable adhesives.

In the case where the said flexible container is in turn inserted inside a second outer container 120, this additional container may be fixed by means of gluing in the external peripheral groove 60, formed in the small frame between the inclined section 46, from which the ribs 62 project, and the external wall 54. In order to avoid accidental opening of the lid part, provision is made for means for holding the lid in closed condition. As shown this is accomplished through the mutual engagement of bosses 25 and 65 positioned, respectively, opposite the hinge, on the wall 18 of the small frame. If desired the lid may be designed to retain a necessary degree of rigidity in view of the small thicknesses adopted for the lid part, by providing, by way of example, ribs 22 in the bottom part of the said lid, as shown in phantom on FIG. 1.

For the opening of the movable lid 10, there is provided a tongue 26 located externally on the wall of the movable lid, in the region of the boss 25.

Figure 4:
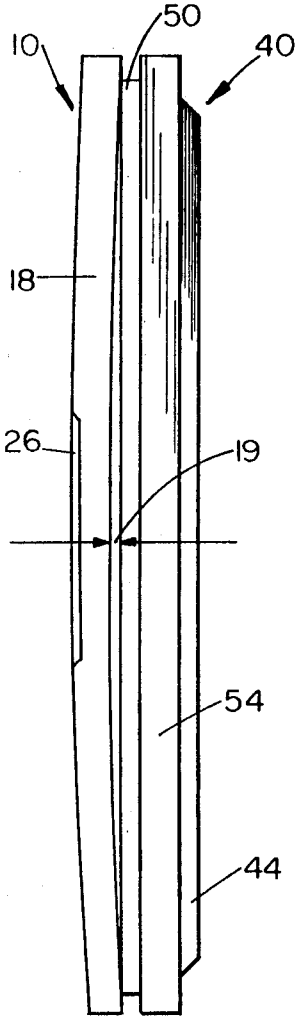
FIG. 4 shows a front elevation of the lid assembly with the lid and the small frame slightly removed from one another.

Finally, particularly in the case where the lid assembly has a rectangular shape, provision is made for the contour of the front part of the movable lid opposite the hinge, comprising the wall 18 and the channel-shaped cavity 20, to be slightly upwardly convex in the vicinity of the boss 25. Thus, during closure of this movable element onto the frame, the two lateral front edges come into contact first with the corresponding front edges of the small frame, ensuring preliminary engagement of these edges, followed by proper marrying of the entire contour of the front part of the movable lid onto the small frame. This slight convexity of the front part of the lid comprising said wall 18 and the channel-shaped cavity 20 is indicated by the play or camber 19 in FIGS. 3 and 4. This curvature, obtained for example by means of hot air, will correspond to a camber of 2–3 mm, after cooling, in the middle part in the region of the boss 25 for holding the lid in the closed position.

The closable lid assembly may be made of any material suitable for creating a hinge from the material itself, provided that it is not excessively rigid. By way of example, grade 15 polypropylene has advantageously been used.

The assembly may be made in any shape and size and may be applied to containers for any product, made of cardboard, metal, plastic and the like, forming a single whole possessing perfect airtightness, being particularly recommended for products whose organoleptic qualities must be protected, such as for example vacuum-packed coffee, which tends to lose its aroma rapidly once the vacuum packaging has been opened.

We claim:

1. An airtight, reclosable coffee package comprising:

(A) a rectangular lid assembly wherein a lid and a frame are formed as a single molded piece, the lid and frame being joined together by a weakened section which acts as a hinge and permits the lid to be placed in superposed relationship with the frame, the lid having along its entire periphery a rectangular channel-shaped cavity, the frame having a flat, inwardly-extending flange with a central opening which delimits an access opening, said flat inwardly extending flange being connected to a rectangular peripheral relief by a steeply inclined section, said rectangular peripheral relief designed to be received in said channel-shaped cavity and having a peripheral channel underlying it, at least one of the flanks of the rectangular peripheral relief having flexible corrugations thereon which cooperate with a wall of the channel-shaped cavity of the lid so that when the two are brought into pressure-contact with each other the corrugations press against the wall of the channel-shaped cavity, providing an airtight seal between the two elements of the lid assembly;

(B) a flexible bag fixed underneath the flat, inwardly-extending flange of the frame in an airtight relationship therewith, said flat inwardly-extending flange having a number of ribs underneath to ensure said airtight relationship, said flexible bag containing coffee in its interior and having provision for an opening to permit access to its interior through the access opening of the flange; and (C) a rigid container enveloping said coffee-containing flexible bag and fixed within the peripheral channel of the frame.

2. The coffee package according to claim 1 in which the underlying part of the lid is ribbed for stiffness.

3. The coffee package according to claim 1 in which the side of the movable lid opposite the hinge has a slight upward convexity with a camber of about 2–3 mm at its center, said camber being located adjacent a base for holding the lid in the closed position following depression of said center of said side.

4. The coffee package according to claim 1 in which a gasket is provided at the bottom of the channel-shaped cavity of the lid for abutment against the top of the peripheral relief of the frame.

* * * * *

UNITED STATES PATENT AND TRADEMARK OFFICE

CERTIFICATE OF CORRECTION

PATENT NO. : 5,110,004

DATED : May 5, 1992

INVENTOR(S) : Mario Albanesi, Willy A.M. Hertogs, Adil M. Khan and Lucio Pieroni It is certified that error appears in the above-identified patent and that said Letters Patent is hereby corrected as shown below:

Column 1, line 44, "containers" should read -- container -- .

Column 4, line 58, "base" should read -- boss -- .

Signed and Sealed this

Thirteenth Day of July, 1993

Michael K. Kirk

*Attest:*

MICHAEL K. KIRK

*Attesting Officer*

*Acting Commissioner of Patents and Trademarks*